US005716191A

United States Patent [19]

Ito et al.

[11] Patent Number: 5,716,191

[45] Date of Patent: Feb. 10, 1998

[54] WESTCO PUMP AND NOISE SUPPRESSION STRUCTURE

[75] Inventors: Motoya Ito, Anjo; Takahiko Kato, Kariya; Minoru Yasuda, Chiryu, all of Japan

[73] Assignee: Nippondenso Co., Ltd., Kariya, Japan

[21] Appl. No.: 597,569

[22] Filed: Feb. 2, 1996

Related U.S. Application Data

[63] Continuation of Ser. No. 483,052, Jun. 7, 1995, abandoned.

[30] Foreign Application Priority Data

Jun. 30, 1994 [JP] Japan ..... 6-149052

[51] Int. Cl.[6] ..... F04D 5/00

[52] U.S. Cl. ..... 415/55.4; 415/55.1

[58] Field of Search ..... 415/55.1, 55.2, 415/55.4, 119

[56] References Cited

U.S. PATENT DOCUMENTS

| | | | |
|---|---|---|---|
| 2,220,538 | 11/1940 | Neibert . | |
| 4,478,550 | 10/1984 | Watanabe et al. . | |
| 4,844,621 | 7/1989 | Umemura et al. | 415/119 |
| 5,011,367 | 4/1991 | Yoshida et al. . | |
| 5,163,810 | 11/1992 | Smith | 415/119 |
| 5,273,394 | 12/1993 | Samuel . | |
| 5,281,083 | 1/1994 | Ito et al. | 415/55.4 |
| 5,336,045 | 8/1994 | Koyama et al. . | |
| 5,372,475 | 12/1994 | Kato et al. . | |
| 5,407,318 | 4/1995 | Ito et al. . | |

FOREIGN PATENT DOCUMENTS

| | | | |
|---|---|---|---|
| 56-120389 | 2/1955 | Japan . | |
| 0173390 | 9/1985 | Japan | 415/55.4 |
| 60-173390 | 9/1985 | Japan . | |
| 0105296 | 5/1988 | Japan | 415/55.4 |
| 4350394 | 12/1992 | Japan . | |
| 61-37300 | 5/1994 | Japan | 415/119 |
| 2220706 | 1/1990 | United Kingdom . | |
| 2263311 | 7/1993 | United Kingdom . | |

OTHER PUBLICATIONS

Patent Abstract of Japan, vol. 012 No. 305 (M–733) Aug. 1988 re–JP–A 63 080092.

Patent Abstract of Japan, vol. 018 No. 491 (M–1672) Sep. 1994 re JP–A 06 159283.

E. Tonn, "Zur Berechnung von Peripheralpumpen" Konstruktion 44 (1992) 64–70.

*Primary Examiner*—Christopher Verdier

*Attorney, Agent, or Firm*—Cushman Darby & Cushman IP Group of Pillsbury Madison & Sutro LLP

[57] ABSTRACT

In order to reduce noise generated in a westco pump when fluid hits a finishing end of a pump channel, finishing ends of grooves formed in a side wall of a casing body and a casing cover to form a pump channel are shifted by an amount equal to ½ of the pitch of blade elements in relation to the rotating direction of an impeller. As a result, the timings the fluid under high pressure hits the finishing ends of the grooves are staggered, thus decreasing the collision sound.

27 Claims, 8 Drawing Sheets

WESTCO PUMP AND NOISE SUPPRESSION STRUCTURE

This is a continuation of application Ser. No. 08/483,052, filed on Jun. 7, 1995, which was abandoned upon the filing hereof.

CROSS REFERENCE TO RELATED APPLICATION

This application is based on and claims priority of Japanese Patent Application No. 6-149052 filed on Jun. 30, 1994, the content of which is incorporated herein by reference.

BACKGROUND OF THE INVENTION

1. Field of the Invention

This invention concerns a westco pump designed to suppress noises generated when fluid under high pressure in a casing collides with a finishing end of a pump channel.

2. Description of Related art

Among conventional westco pumps such as shown in FIGS. 13A and 13B, an impeller 1 is composed of multiple blade elements 4 protruding into a pump channel 3 inside a casing 2 on the outer circumference. Moreover, pump grooves 5 between the individual blade elements 4 are divided into two by a separating wall 6. When the impeller 1 is rotated inside the casing 2, the fluid taken into the pump channel 3 via an intake hole not shown in the figures flows into the pump grooves 5 in the direction shown by an arrow A to receive kinetic energy from the blade elements 4 and be sent to the pump channel 3, after which it is joined with a main stream which moves toward a discharge hole not shown in the figures. At this time, there is a reduction in speed of the fluid sent from the pump grooves 5 to the pump channel 3 so that the kinetic energy it possessed up to then is converted into pressure energy and the pressure of the main stream travelling through the pump channel 3 is increased. In this way, along with an increase in pressure, the fluid that flows through the pump channel 3 toward the discharge hole not shown in the figures finally collides with the finishing end of the pump channel 3 and is discharged from the discharge hole while changing direction.

In the westco pump of the structure described above, the blade elements 4 are located at the same position on both sides of the separating wall 6. The blade elements 4 on both sides of the separating wall 6 simultaneously pass through the finishing end of the pump channel 3. As a result, the fluid sent from the pump grooves 5 on both sides of the separating wall 6 collides at the same time with the finishing end of the pump channel 3 so that the noise created by the collision of the fluid is considerable.

With this westco pump, the discharge volume is small but it is possible to obtain quite a high discharge pressure even with fluids having low viscosity. In recent years, for example, it is used as a fuel pump for automobiles. However, because requirements regarding noise in a passenger compartment are particularly strict for passenger cars, the westco pump of the type described above causing excessive noise is not desirable in terms of noise reduction.

SUMMARY OF THE INVENTION

This invention has been made with the above considerations in mind. Its purpose is to provide a westco pump which offers a reduction in noise.

This invention is based on the following findings.

In a westco pump according to the invention, a radial seal is provided on an inner circumference of a circular peripheral wall in order to seal between an intake hole and a discharge hole. Likewise, an axial seal is provided on an inner surface of both side walls. In addition, a small amount of clearance (radial clearance) is created between the radial seal and an impeller, and a small amount of clearance (axial clearance) is created between the axial seal and the impeller. Generally, it is so set that the radial clearance Rc is larger than the axial clearance Ac (Rc>Ac). Conversely, there are cases where the radial clearance Rc is set smaller than the axial clearance Ac (Rc<Ac).

In the westco pump set so that Rc>Ac, the fluid sent from the pump grooves on both sides of the separating wall of the impeller collides simultaneously with the finishing end of both side walls of the finishing ends of the pump channel, this being the main reason for noise. In the westco pump set so that Rc<Ac, the main reason for generation of noise is that the fluid sent from the pump grooves on both sides of the separating wall of the impeller collides simultaneously with the finishing end of the circular peripheral wall of the finishing ends of the pump channel.

Therefore, according to the invention, in a westco pump set so that Rc>Ac, a finishing end of a pump channel formed on the inner surface of both side walls is shifted in a circumferential direction on both side walls so that the collision timing of the fluid on the pump channel finishing end of both side walls (the main cause of noise generation) is staggered on both side walls, thus reducing noise.

Preferably, a discharge hole is provided on one side wall of the two side walls so that the finishing end of the pump channel formed on the inner surface of one side wall is shifted in the rotational direction of the impeller in relation to the finishing end of the pump channel formed on the inner surface of the other side wall. Thus fluid which has reached the finishing end of the pump channel is discharged smoothly and there occurs no danger of pushing the impeller in the direction of thrust and causing abnormal wear on the inner surface of the impeller side wall.

Alternatively, in a westco pump set so that Rc<Ac, because the finishing end of the pump channel formed on the inner circumference of the circular peripheral wall is shifted in a circumferential direction on both sides of the separating wall of the impeller, the timing for collision of fluid against the pump channel finishing end of the circular peripheral wall (main cause of noise) is staggered on both sides of the separating wall, thus reducing noise.

Furthermore, by displacing the starting end of the pump channel in the circumferential direction, the timing by which the fluid under high pressure flows from the finishing end of the pump channel via the seal to the starting end undergoes a rapid decrease in pressure at the starting end and is staggered on both sides in an axial direction, thus making it possible to reduce the noise generated on the starting end.

Still furthermore, by making the shift amount of the pump channel ends to be half of the pitch of the blade elements, it is possible to reduce noise even further.

DETAILED DESCRIPTION OF THE PREFERRED EMBODIMENTS

Figure 5:
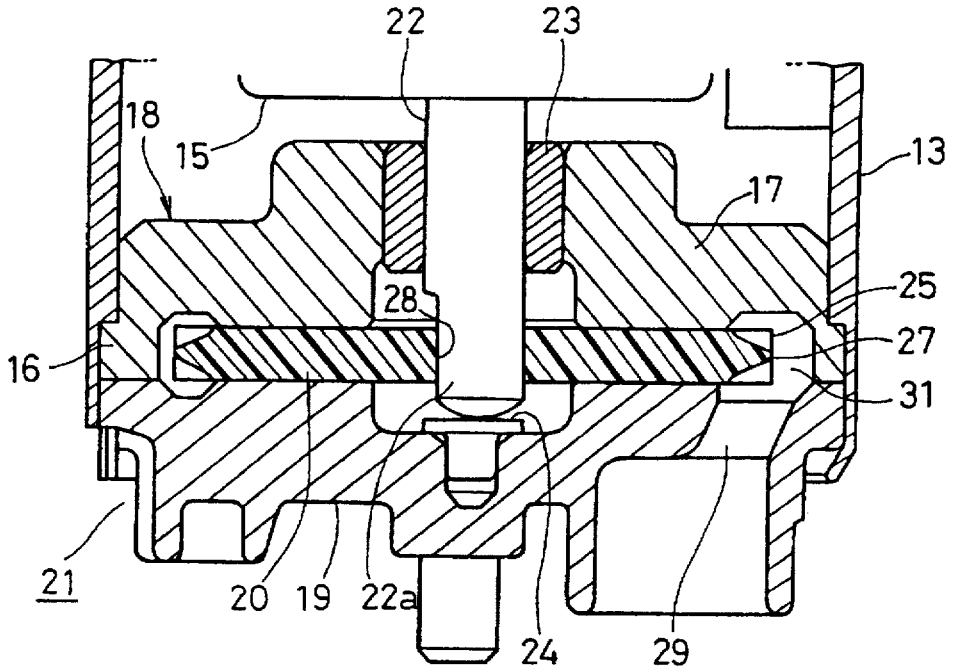
FIG. 5 is a longitudinal cross-sectional front view of the entire structure of the westco pump.
Figure 6:
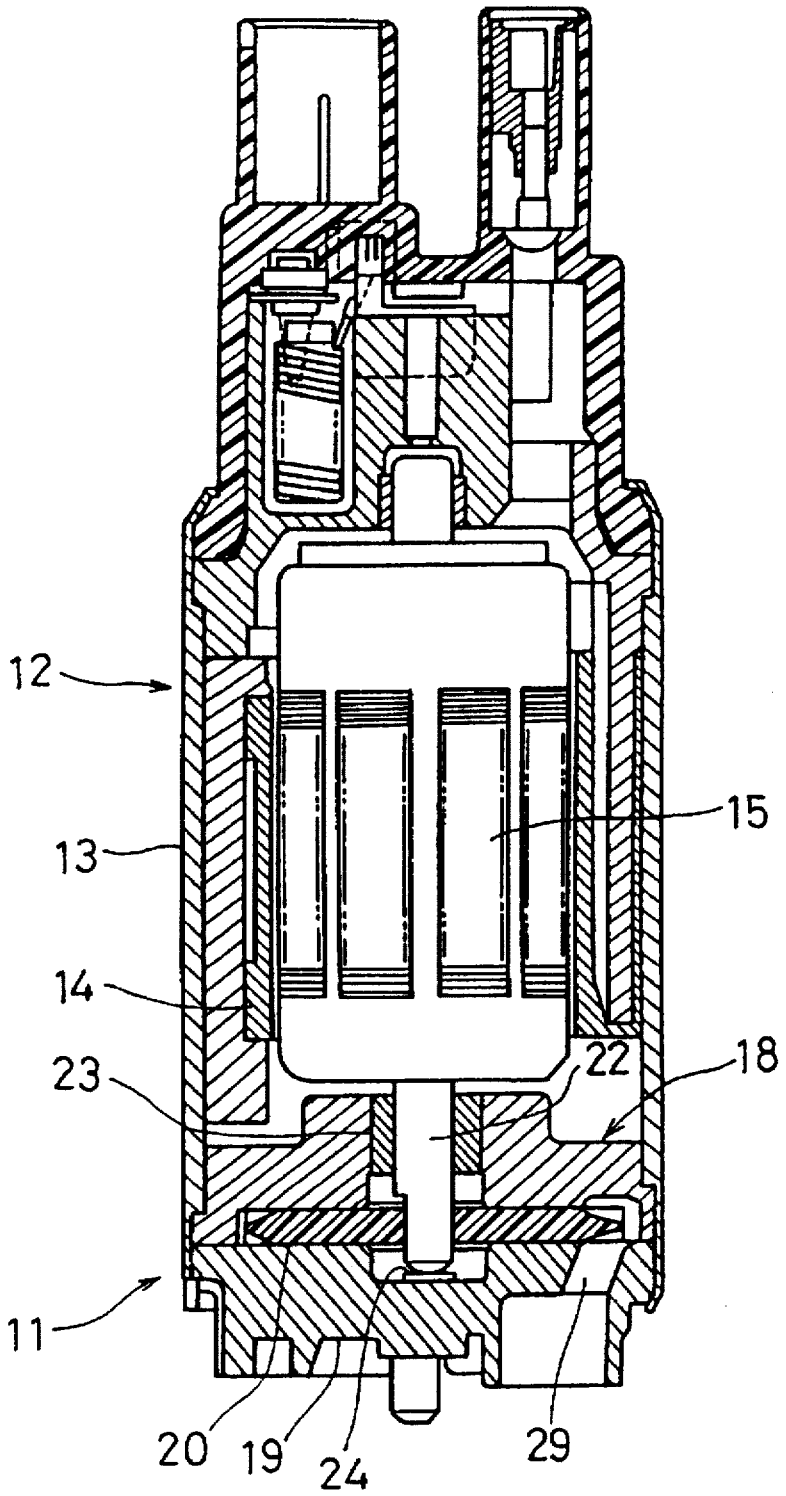
FIG. 6 is a longitudinal cross-sectional front view of the entire structure of a fuel pump.

Next follows a description of a first embodiment of this invention as an automobile fuel pump with reference to FIG. 1 to FIG. 7. As shown in FIG. 6, a fuel pump is composed of a pump section 11 and a motor section 12 to drive the pump section 11. The motor 12 is composed of a DC motor with a brush. Permanent magnets 14 are located in a cylindrical form in a cylindrical housing 13. A rotor 15 is located concentrically in the inner circumference of the permanent magnets 14.

Meanwhile, the pump section 11 is composed of a westco pump. As shown in FIG. 5, it is composed of a casing body 18 including as a single unit a circular peripheral wall 16 containing a circular inner circumference and a side wall 17 closing one side of the circular peripheral wall 16, a casing cover 19 acting as a side wall to close the other side of the circular peripheral wall 16, and an impeller 20.

Of these elements, the casing body 18 and the casing cover 19 are formed, for example, by aluminum diecast molding. The casing body 18 is press-fitted on one end of the housing 13 while the casing cover 19 is secured to one end of the housing 13 by crimping, etc. in such a way that it covers the casing body 18. This provides a hermetically sealed single casing 21 composed of the casing body 18 and the casing cover 19. In such a case, a shaft 22 of the rotor 15 acting as the drive axle of the pump section 11 is inserted and supported in such a way that it can rotate freely in a bearing 23 fitted in the center of the side wall 17 of the casing body 18, so that the thrust load is received by a thrust bearing 24 secured to the center of the casing cover 19.

The impeller 20 is formed integrally by phenol resin with glass fiber or PPS and formed with multiple blade elements 25 on the outer circumference thereof in a circumferential direction at a fixed interval. A separating wall 27 dividing blade grooves 26 (FIG. 1 and FIG. 3) of the blade elements 25 in an axial direction is also formed. The blade elements 25 protruding into both sides of the separating wall 27 are so configured that they are located at the same position. The impeller 20 is housed in the casing 21 rotatably. A joining hole 28 (FIG. 3) located in the center and having roughly a D-shape is fitted slidably in an axial direction on a D-cut section 22*a* of the shaft 22 acting as a rotation axle. As a result, the impeller 20 rotates together with the shaft 22 as a single unit and is movable in the axial direction in relation to the shaft 22.

The casing cover 19 is formed with an intake hole 29 communicating with a fuel tank (not shown in figures). Formed on the side wall 17 of the casing body 18 in the vicinity of the intake hole 29 is a discharge hole 30 (FIG. 1) communicating with an injector (not shown in figures). Formed on the inner circumference of the casing 21 is a pump channel 31 connecting the intake hole 29 and the discharge hole 30. The blade elements 25 of the impeller 20 are protruding into the pump channel 31. In the following description, one end of the two terminal ends of the pump channel 31 on the side of the intake hole 29 is denoted as the "starting end" and the other end of the same on the side of the discharge hole 30 is denoted as the "finishing end."

Figure 3:
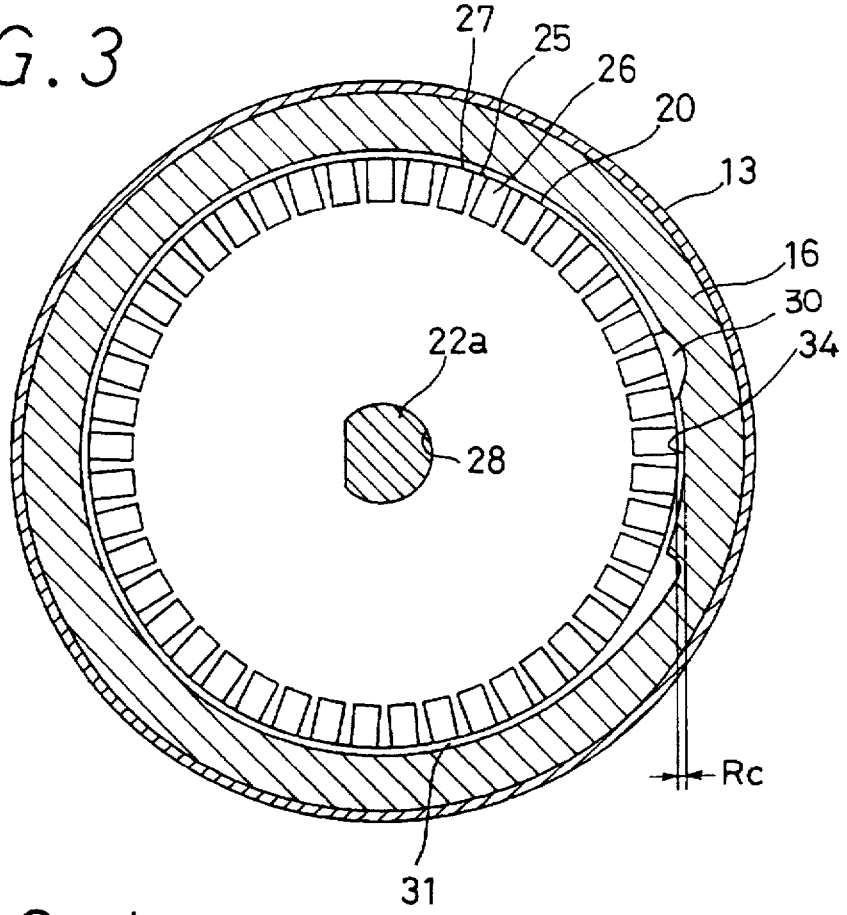
FIG. 3 is a horizontal cross-sectional view of the westco pump.
Figure 4A:
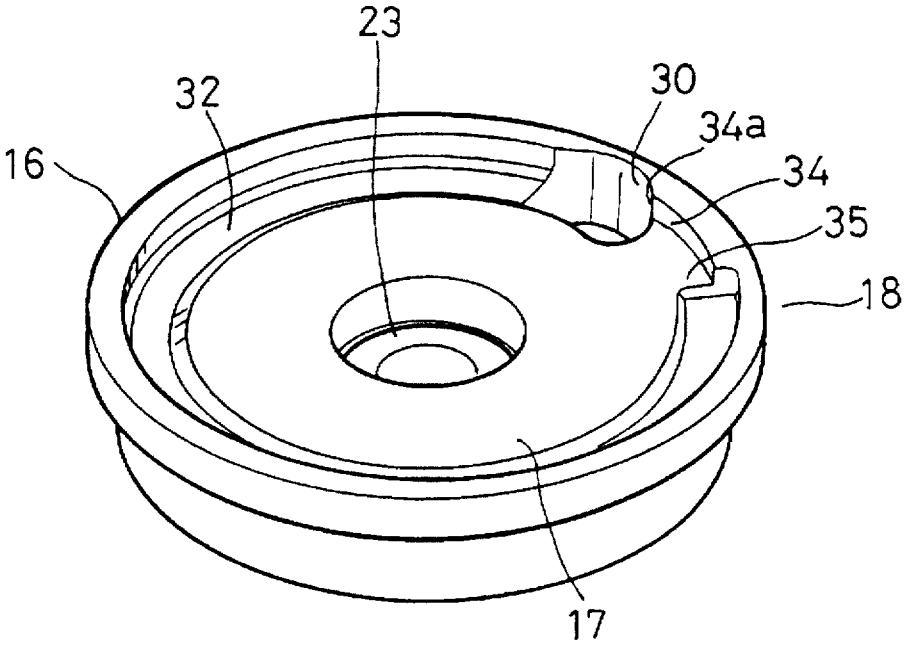
FIG. 4A is a perspective view of the casing body and FIG. 4B is a perspective view of the casing cover.
Figure 4B:
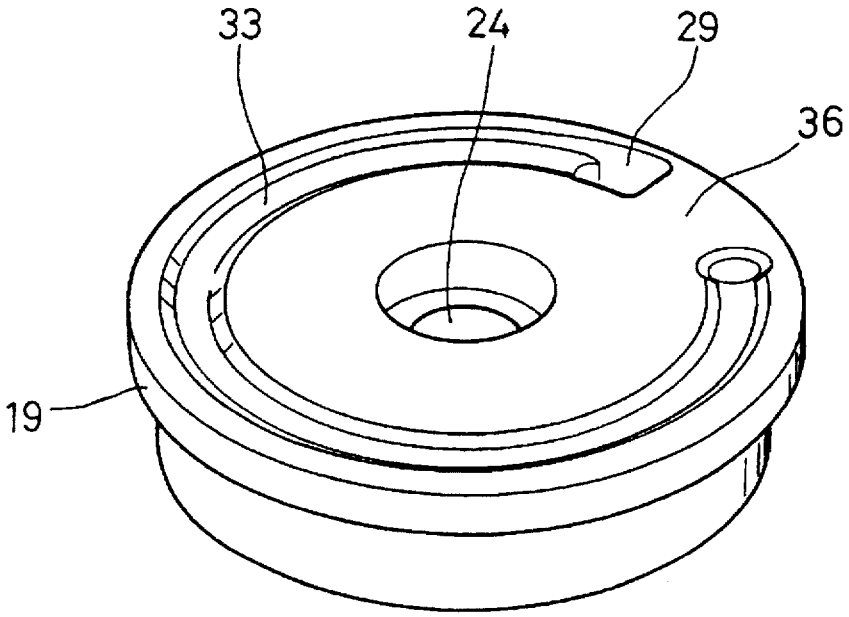

As shown in FIG. 3, one part of the pump channel 31 at the side of the outer circumference of the blade elements 25 is formed by designing the inside diameter of the circular peripheral wall 16 of the casing body 18 larger than the outside diameter of the impeller 20. The other part of the pump channel 31 at the axial sides of the blade elements 25 are formed, as shown in FIGS. 4A and 4B, by grooves 32 and 33 on the inner surface of the side wall 17 of the casing body 18 and the inner surface of the casing cover 19. Of the inner circumference of the circular peripheral wall 16 of the casing body 18, the part located between the end of the groove 32 in the position opposing the intake hole 29 of the casing cover 19 and the discharge hole 30 projects out in an arc-shape. The arc-shaped projection works as the radial seal 34. The parts between both ends of the groove 32 of the side wall 17 of the casing body 18 and between both ends of the groove 33 of the casing cover 19 (i.e., the parts projecting from the bottom side of the groove 33 and being flush with the inner surfaces of the side wall 17 and the casing cover 19) work as the axial seals 35 and 36. In this case, the lengths in a circumferential direction of the axial seals 35 and 36 of the side wall 17 and the casing cover 19 are set to the same value.

Figure 1:
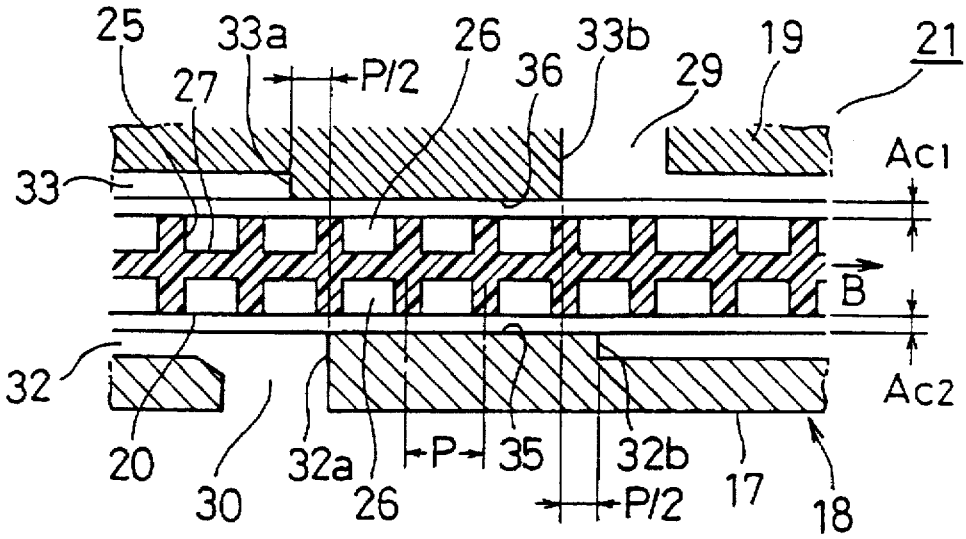
FIG. 1 is a longitudinal cross-sectional side view of a seal of a westco pump showing a first embodiment of the invention.
Figure 2:
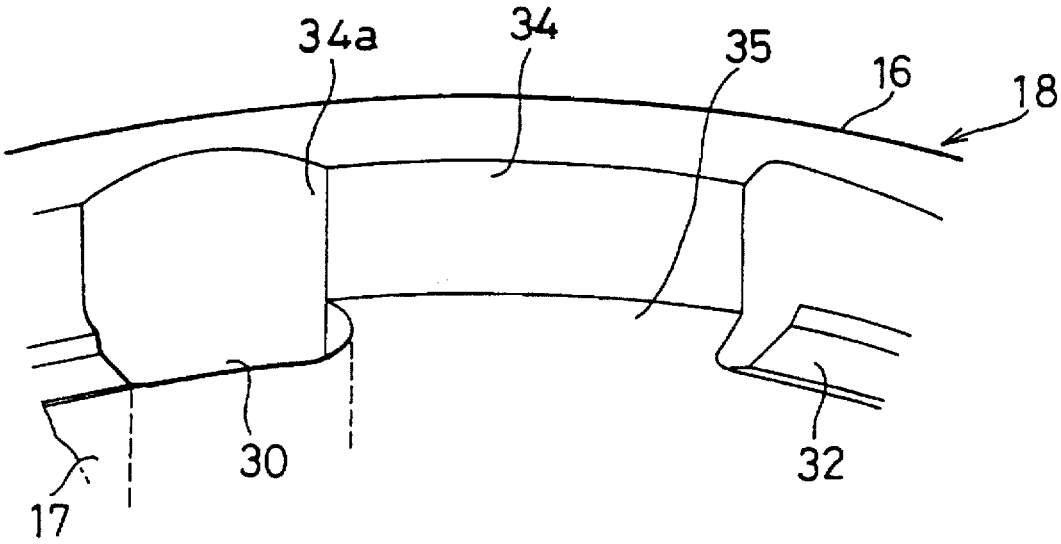
FIG. 2 is a perspective view of the seal of a casing body shown by removing a casing cover.

As shown in FIG. 3, there is only a small amount of clearance (radial clearance Rc) maintained between the radial seal 34 and the outer circumference of the impeller 20 (top end surfaces of the blade elements 25 and separating wall 27). Further, as shown in FIG. 1, there is only a small amount of clearance (axial clearance Ac1 and Ac2) maintained between the axial seals 35, 36 and both sides of the impeller 20 in the axial direction (both sides of the blade element 25 in the axial direction). In FIG. 1 and FIG. 3, the clearances Rc, Ac1 and Ac2 are illustrated in exaggeration. In the present embodiment, the radial clearance Rc is set, for example, between 50 micrometers and 150 micrometers, and the axial clearance Ac (sum of Ac1 and Ac2) is set, for example, between several micrometers and several tens of micrometers. Thus, the radial clearance Rc is set larger than the axial clearance Ac.

The inventors have found that, when the radial clearance Rc is greater than the axial clearance Ac as described above, the main source of noise is the sound generated when the fluid sent from the impeller blade groove collides simultaneously with the finishing ends of both sides in an axial direction of the blade elements in the finishing end of the pump channel. As a result, in the present embodiment, the finishing end of the groove 32 (pump channel) of the side wall 17 of the casing body 18 and the finishing end of the groove 33 (the pump channel) of the casing cover 19 are designed so that they are shifted in a circumferential direction. In such a case, of the two side walls (i.e., side wall 17 and casing cover 19) closing off both sides of the circular peripheral wall 16 of the casing 21, a finishing end 32*a* of the groove 32 of the side wall 17 including the discharge hole 30 is shifted, relative to a finishing end 33*a* of the groove 33 of the casing cover 19 acting as the other side wall, by an amount equal to about one half of the pitch P of the circumferentially adjacent two of the blade elements 25 in the rotational direction (shown by an arrow B in the figure) of the impeller 20.

Also, in the present embodiment, the lengths in a circumferential direction of the axial seal 35 of the side wall 17 of the casing body 18 and the axial seal 36 of the casing cover 19 are set to the same length. As a result, a starting end 32*b* of the groove 32 of the side wall 18 is shifted, also by an amount equal to about one half of the pitch distance of the blade element 25 of the impeller 20 in a rotational direction, relative to a starting end 33*b* of the groove 33 of the casing cover 19.

Next follows a description of the function of the above embodiment. When the motor 12 is started, the impeller 20 rotates in the direction shown by the arrow B together with the shaft 22 of the rotor 15. As a result, the blade elements 25 on the outer circumference of the impeller 20 rotate along the arc-shaped pump channel 31 to create pump action and thus takes fuel inside a fuel tank (not shown in the figures) from the intake hole 29 into the pump channel 31. The fuel that has been taken into the pump channel 31 flows into each blade groove 26 and receives kinetic energy from the blade elements 25, so that it is sent to the pump channel 31 in a continuous process. Thus, as the pressure is raised, the fuel flows into the pump channel 31 toward the discharge hole 30. The fuel collides with the finishing end of the pump channel 31, end surface 34*a* of the radial seal 34 and the finishing ends 32*a*, 33*a* of the grooves 32 and 33, and is discharged from the discharge hole 30 while changing flow direction. It is then sent under pressure to the injector (not shown in the figures).

In the case of the westco pump set as in the present embodiment so that Rc>Ac, the main source of noise, as mentioned above, is the sound generated when the fuel under high pressure collides with the finishing ends 32*a*, 33*a* of the grooves 32, 33 of the pump channel 31. In the present embodiment the finishing ends 32*a* and 33*a* of the grooves 32, 33 are shifted from each other in a circumferential direction so that the timings by which the fuel under high pressure hits the finishing ends 32*a* and 33*a* are staggered, thus effectively reducing noise during operation of the pump.

Figure 7:
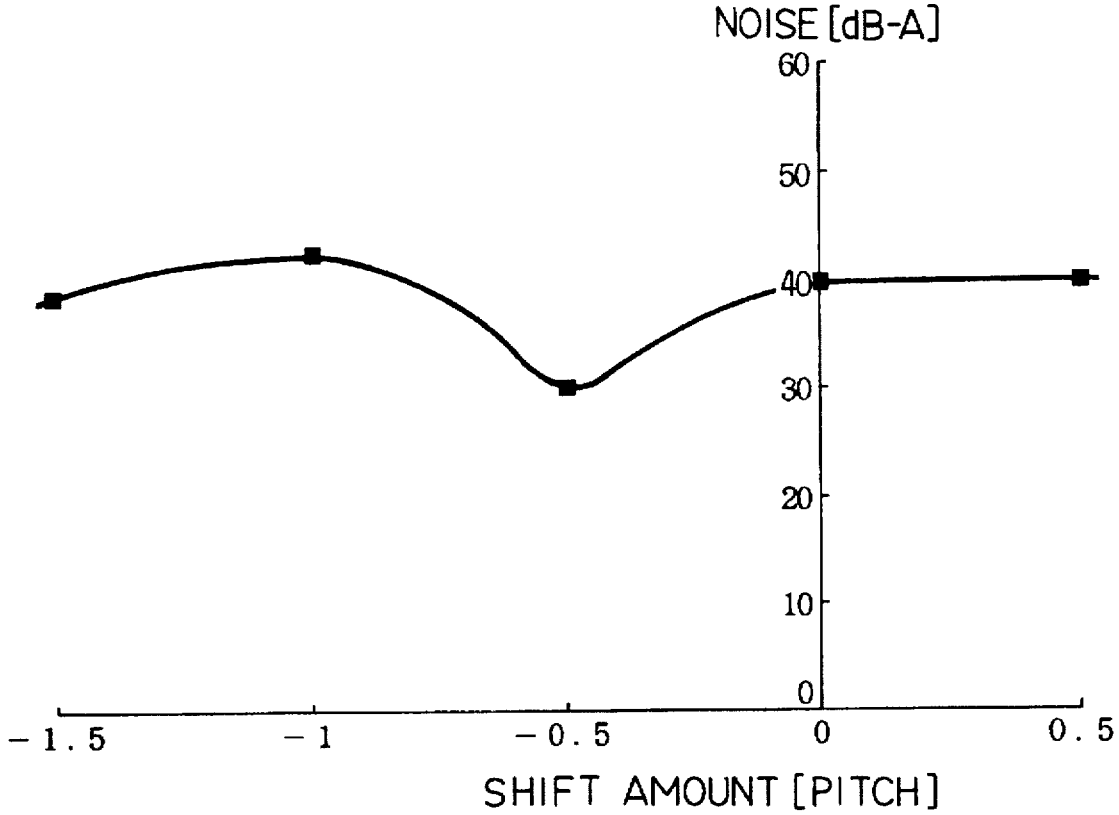
FIG. 7 is a graph of experimental results showing the relationship between the shift amount and noise.

In such a case, as in the present embodiment, the finishing end 32*a* of the groove 32 of the side wall 17 is shifted in the rotational direction of the impeller 20 relative to the finishing end 33*a* of the groove 33 of the casing cover 19. The shift amount is set as roughly one half of the pitch P of the blade elements 25, thus achieving an even greater reduction in noise. FIG. 7 shows the results of changing the shift amount of the finishing ends 32*a*, 33*a* of the grooves 32, 33 and the measured result of the amount of noise. In the figure, the shift amount is expressed as a minus value when the finishing end 32*a* of the groove 32 of the side wall 17 containing the discharge hole 30 is shifted in the rotational direction of the impeller 20 in relation to the finishing end 33*a* of the groove 33 of the casing cover 19. In like manner, it is expressed as a plus value if it is shifted in a direction opposite to the rotational direction of the impeller 20. It can be understood from FIG. 7 that the noise reduction effect is greater in the present embodiment where the finishing end 32*a* of the groove 32 is shifted by an amount equal to about ½ the pitch P of the blade elements 25 in the rotational direction of the impeller 20 relative to the finishing end 33*a* of the groove 33.

Furthermore, if the shift amount is (+P/2) (i.e., if the finishing end 32*a* of the groove 32 is shifted by an amount P/2 in the opposite direction of the rotational direction of the impeller 20 relative to the finishing end 33*a* of the groove 33), there is almost no noticeable reduction in noise. As is explained later, this is because the finishing end 33*a* of the groove 33 is on the rotational direction side of the impeller 20 relative to the discharge hole 30 and, hence the fuel hitting the finishing end 33*a* of the groove 33 has no place to escape and the pressure increases.

Also, of the finishing ends 32*a*, 33*a* of the grooves 32, 33, the finishing end 32*a* of the groove 32 of the side wall 17 including the discharge hole 30 is shifted in the rotational direction of the impeller 20 relative to the finishing end 33*a* of the groove 33 of the casing cover 19. As a result, the fuel hitting the finishing end 33*a* of the groove 33 smoothly changes flow direction and flows out from the discharge hole 30. In other words, if a situation opposite to the present embodiment is assumed that the finishing end 33*a* of the groove 33 of the casing cover 19 is shifted in the rotational direction of the impeller 20 relative to the finishing end 32*a* of the groove 32 of the side wall 17, the discharge hole 30 is located in a direction more opposed to the rotational direction of the impeller 20 compared with the finishing end 33*a* of the groove 33. As a result, the fuel under high pressure hitting the finishing end 33*a* of the groove 33 has no place to escape. This creates a relatively large pressure difference on both sides in the axial direction of the impeller so that the impeller 20 is pushed strongly against the side wall 17. In such a case, one side of the impeller 20 contacts the inner surface of the side wall 17 causing abnormal wear. However, as mentioned above, in the present embodiment the finishing end 32*a* of the groove 32 of the side wall 17 including the discharge hole 30 is shifted in the rotational direction of the impeller 20 relative to the finishing end 33*a* of the groove 33 of the casing cover 19. As a result, the fuel hitting the finishing end 33*a* of the groove 33 changes its flow direction smoothly and flows out from the discharge hole 30. Thus, there is no pushing of the impeller 20 against the side of the side wall 17 and no danger of abnormal wear.

Furthermore, in the case where the discharge hole 30 is formed on the circular peripheral wall 16, even if the finishing end 32*a* of the groove 32 is shifted in the opposite direction of the rotational direction of the impeller 20 relative to the finishing end 33*a* of the groove 33, the fuel hitting the finishing end 33*a* of the groove 33 flows smoothly from the discharge hole 30. Thus, results are favorable even with the structure in which the finishing end 32*a* of the groove 32 is shifted in the opposite direction of the rotational direction of the impeller 20 relative to the finishing end 33*a* of the groove 33. With such a structure, even if the finishing end 33*a* is shifted in the rotational direction of the impeller 20 relative to the finishing end 32*a* so that the amount of shift is roughly one half of the pitch of the blade elements 25, it is possible to obtain a major reduction in noise.

Also, fuel hitting the finishing ends of the grooves 32, 33 may flow to the starting ends 32*b*, 33*b* of the grooves 32, 33 via the axial clearances Ac1, Ac2. In such a case, there occurs a sudden reduction in pressure producing a shock noise. With the present embodiment, however, the starting ends 32*b*, 33*b* are shifted by an amount equal to ½ of the pitch P of the blade elements 25 in the rotational direction of the impeller 20. As a result, even if part of the fuel hitting the finishing ends 32*a*, 33*a* of the grooves 32, 33 leaks to the starting ends 32b, 33b of the grooves 32, 33 via the axial clearances Ac1, Ac2, because there is staggering of timings, there is reduction in shock sound (noise).

Figure 8:
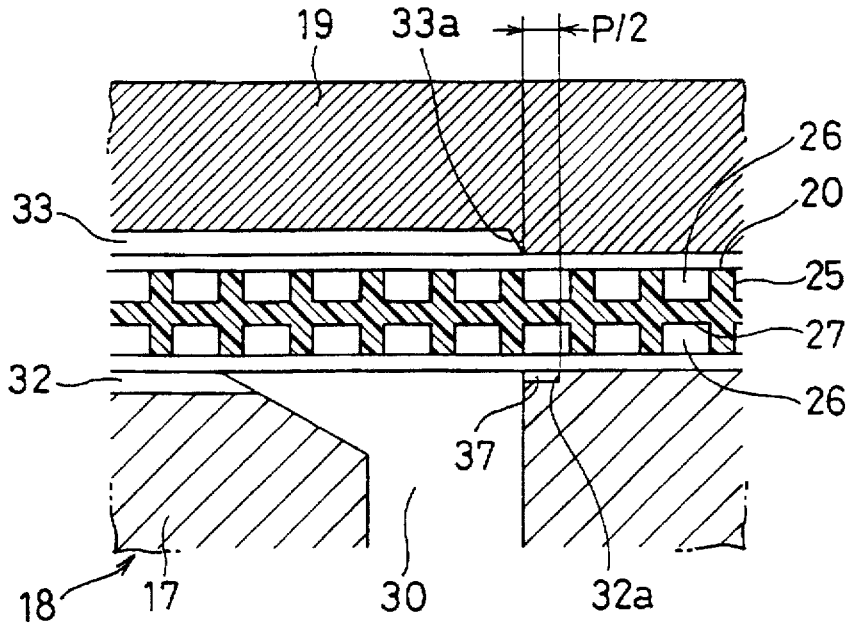
FIG. 8 is a cross-sectional view showing a second embodiment of the invention.
Figure 9:
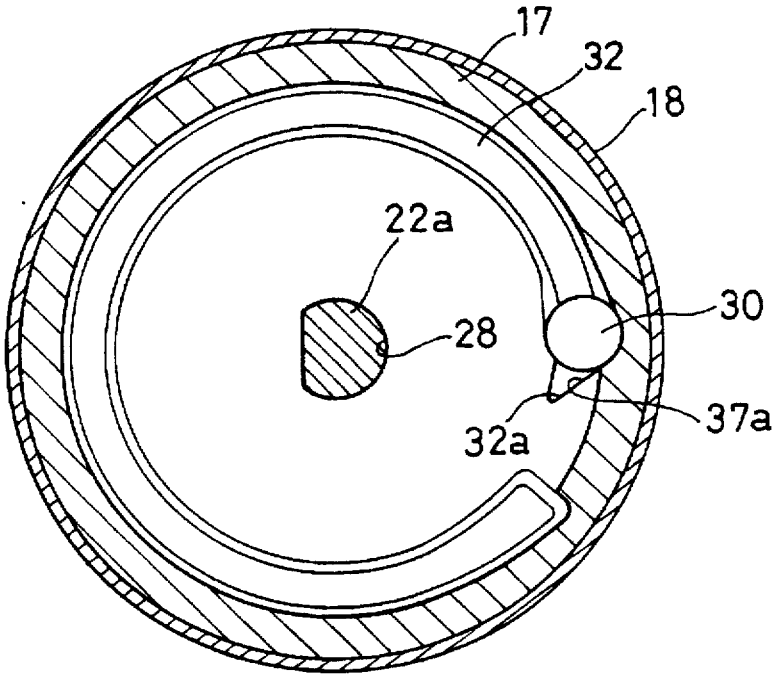
FIG. 9 is a horizontal cross-sectional view of the casing body.

FIG. 8 and FIG. 9 show a second embodiment of the invention. The same reference numerals are used for parts that are the same as in the first embodiment in FIG. 1, and there is description of differing parts.

The finishing end of the groove 32 itself of the side wall 17 of the casing body 18 and the finishing end 33a of the groove 33 of the casing cover 19 are located in the same position in the circumferential direction. Formed is an extension groove 37 whose length from the finishing end of the groove 32 itself of the side wall 17 of the casing body 18 in the rotational direction of the impeller 20 is equal to ½ of the pitch P of the blade element 25. As a result, the finishing end 32a of the groove 32 including the extension groove 37 is formed so that it is substantially shifted by an amount equal to roughly ½ of the pitch P of the blade elements 25 in the rotational direction of the impeller 20 relative to the finishing end 33a of the groove 33. Thus, even with such a structure, it is still possible to obtain the same operational effects as in the first embodiment.

As shown in FIG. 9, in such a case the inner surface of the extension groove 37 is formed along a slanted surface 37a, and the shock when the fuel hits the finishing end 32a of the extension groove 32 is relieved by the slanted surface 37a so that the noise reduction effect is increased.

Figure 10:
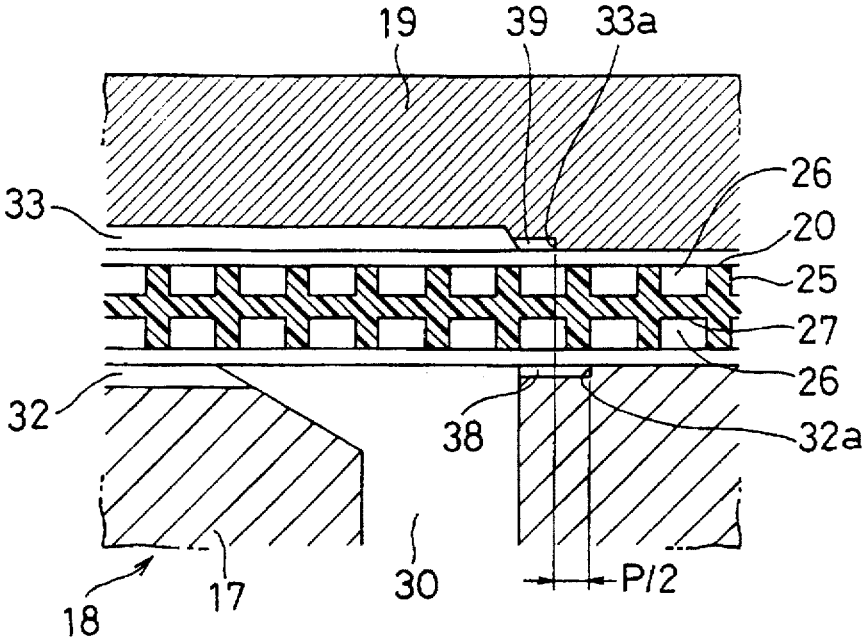
FIG. 10 is a cross-sectional view showing a third embodiment of the invention.

Such an extension groove 37 can be formed in both grooves 32 and 33. Such a case is shown as a third embodiment in FIG. 10.

In the figure, the finishing end of the groove 32 of the side wall 17 of the casing body 18 and the finishing end of the groove 33 of the casing cover 19 are located in the same position in relation to a circumferential direction. This agrees with the second embodiment in FIG. 8. Extension grooves 38, 39 with different lengths are formed in the finishing ends of the grooves 32, 33 extending in the rotational direction of the impeller 20. As a result of the extension grooves 38, 39, the finishing ends 32a, 33a of the grooves 32, 33 are in a condition where they are substantially shifted in the circumferential direction. In such a case, the extension groove 38 is formed so that it is shifted an amount equal to ½ the pitch P of the blade elements 25 in the rotational direction of the impeller 20 in relation to extension groove 39.

Figure 11:
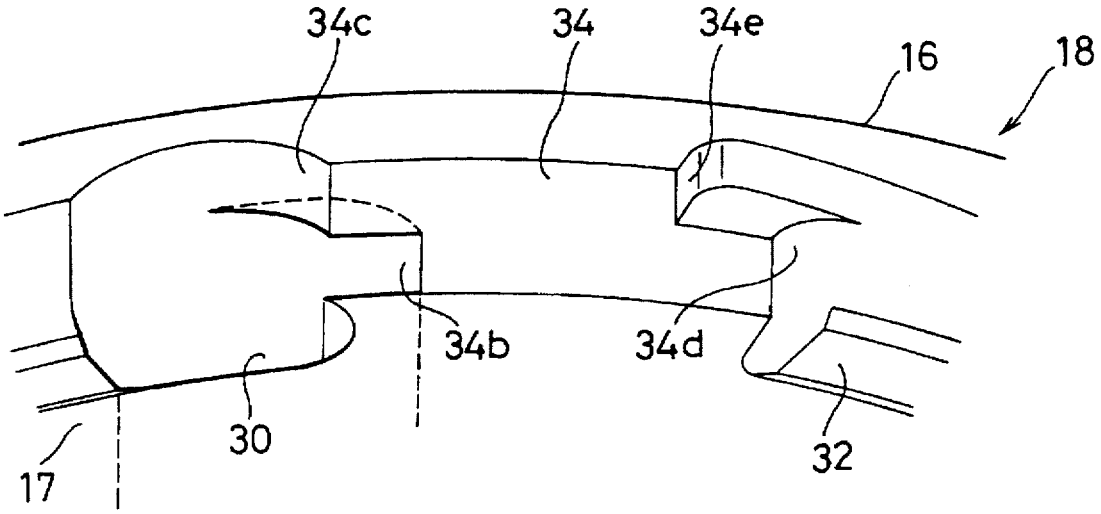
FIG. 11 is a perspective view showing a fourth embodiment of the invention.

In the first to third embodiments, the radial clearance Rc is made larger than the axial clearance Ac. Conversely, a fourth embodiment in FIG. 11 shows a structure for noise reduction in the case where the axial clearance Ac is made larger than the radial clearance Rc. If Rc<Ac, the main cause of noise generation is fuel under high pressure hitting the finishing end (one end of radial seal 34) of the pump channel 31 of the circular peripheral wall 16 of the casing body 18. In the fourth embodiment in FIG. 11, at one end of the radial seal 34 which is the finishing end of the pump channel 31 of the circular peripheral wall 16, the position of the end surfaces 34b, 34c on both sides of the separating wall 27 of the impeller 20 in an axial direction are shifted in the rotational direction of the impeller 20. In such a case, even on the other end of the radial seal 34 which is the starting end of the pump channel 31, the position of the end surfaces 34d, 34e on both sides of the separating wall 27 of the impeller 20 in the axial direction is shifted in relation to the rotational direction of the impeller 20.

In the present case, the end surfaces 34b, 34d of the side wall 17 including the discharge hole 30 are shifted in the rotational direction of the impeller 20 by an amount equal to ½ of the pitch P of the blade elements 25 of the impeller 20 relative to the end surfaces 34c, 34e on the opposite side. The end surface 34b on the side of the discharge hole 30 passes on a straight line through the outside of the casing body 18 to form one part of the inner surface of the discharge hole 30. The fuel which hits the end surface 34b changes flow direction and is discharged smoothly from the discharge hole 30.

In the embodiment as described, the fuel which flows in the pump channel 31 towards the discharge hole 30 hits the end surfaces 34b, 34c which are the finishing ends. At this time, because the positions of the end surfaces 34b and 34c are dislocated, there occurs staggering of timings and effective noise reduction is attained.

Also, the positions of the end surfaces 34d, 34e that are the starting ends of the pump channel 31 are also shifted. Therefore, even if the fuel under high pressure leaks to the starting ends via the radial clearance Rc, because the timings of reduction in pressure on both sides of the separating wall 27 of the impeller 20 due to fuel leak to the starting ends of the pump channel 31 are staggered, there is effective noise reduction on the starting end of the pump channel 31.

Furthermore, in the case of a westco pump in which the radial clearance Rc and axial clearance Ac are set to the same value (Rc=Ac), it is possible to either adopt one of the first through fourth embodiments or to adopt a structure which combines one of the first through third embodiments with the fourth embodiment.

Figure 12:
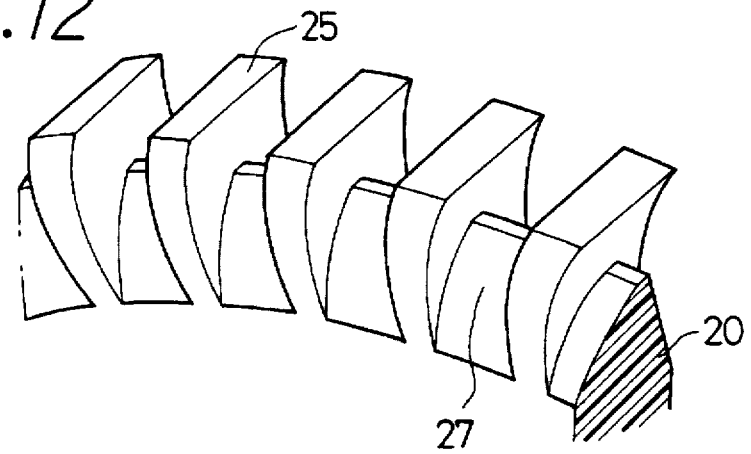
FIG. 12 is a partial perspective view of a modification of the impeller.
Figure 13A:
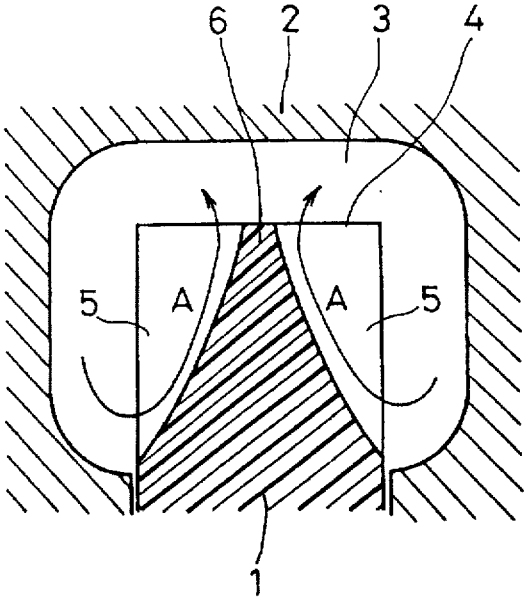
FIG. 13A PRIOR ART
FIGS. 13A and 13B are a longitudinal partial cross-sectional view and a partial perspective view of a prior art westco pump.
Figure 13B:
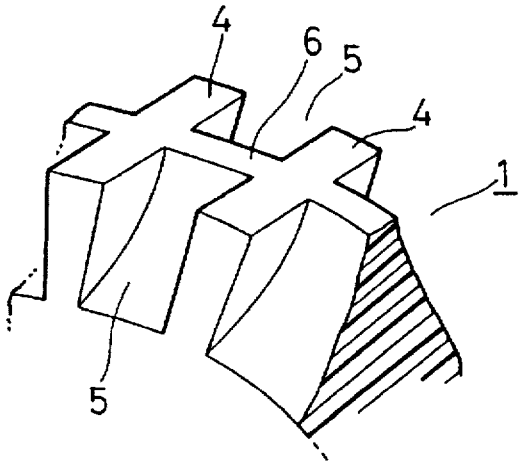
FIG. 13B PRIOR ART

Also, use of the westco pump in this invention is not limited to use as a fuel pump. It can be used widely as a pump for fluids. Further, the invention may be applied to a westco pump which has, as shown in FIG. 12, an impeller 20 formed with blade elements 25 and a separation wall 27. The blade elements 25 are made into an arcuate shape and the separation wall 27 is made shorter radially than the top ends of the blade elements 25.

As explained above, according to this invention, in the westco pump in which the radial clearance is set larger than the axial clearance, the finishing ends of the pump channel formed in both side walls of the casing are shifted in the circumferential direction. As a result, the timings of collision of fluid at the pump channel finishing end at both side walls (the main cause of noise) is staggered at both side walls, thus reducing noise.

Also, if the discharge hole is formed on one of the side walls of both side walls, the finishing end of the pump channel formed on the inner surface of one of the side walls shifts in the rotational direction of the impeller relative to the finishing end of the pump channel formed on the inner surface of the other side wall. As a result, the fluid which reaches the finishing end of the pump channel is smoothly discharged from the discharge hole and there occurs no abnormal wear caused by the impeller being pushed in the direction of thrust.

In the westco pump in which the axial clearance is set larger than the radial clearance, the finishing end of the pump channel formed in the inner circumference of the circular peripheral wall of the casing is shifted in the circumferential direction on both sides of the separating wall of the impeller. As a result, the timings of the collision of the fluid against the pump channel finishing end of the circular peripheral wall (the main cause of noise) is staggered at both side walls, thus reducing noise.

Also, by shifting the starting end of the pump channel in the circumferential direction, staggered is the timings of the reduction of pressure of the fluid under high pressure which leaks from the finishing end of the pump channel to the starting end via the clearance of the seal undergoes a sudden decrease in pressure at the pump channel starting end. It is thus possible to reduce noise at the starting ends of the pump channel.

Furthermore, by adopting a structure in which the shift amount of the end of the pump channel is half the value of the pitch of the blade elements, it is possible to reduce noise even further.

What is claimed is:

1. A westco pump comprising:

a casing in which both sides of a circular peripheral wall are closed by side walls, and forming an intake hole, a discharge hole and a pump channel in a form of a groove connecting the two holes; and an impeller disposed in the casing and formed with multiple blade elements and with a separating wall dividing the pump channel axially into pump grooves between the blade elements, wherein, of starting ends and finishing ends of the pump channel formed on the inner surfaces of the side walls, the finishing ends are shifted from each other by about one half of a pitch of the blade elements in a circumferential direction at the side walls.

2. A westco pump as in claim 1, wherein:

the peripheral wall is formed integrally with one of the side walls.

3. A westco pump as in claim 2, wherein:

the discharge hole is formed on one side wall of the side walls; and the finishing end of the pump channel formed on the inner surface of the one side wall is shifted in an impeller rotation direction relative to the finishing end of the pump channel formed on the inner surface of the other side wall.

4. A westco pump as in claim 3, wherein:

the starting ends are shifted in the circumferential direction from each other in the impeller rotation direction; and the shift amount of the starting ends is about one half of the pitch of the blade elements.

5. A westco pump as in claim 4, wherein:

the blade elements are formed to extend radially on the outer periphery of the impeller.

6. A westco pump as in claim 5, wherein:

a radial clearance between the impeller and a radial seal part formed on the inner circumference of the circular peripheral wall to seal between the intake hole and the discharge hole is made larger than an axial clearance between the impeller and an axial seal part formed on the inner surface of the side walls to seal between the intake hole and the discharge hole.

7. A westco pump as in claim 1, wherein:

one of the side walls is formed with an extension groove extending from the pump channel further beyond the discharge hole in an impeller rotation direction and defining the finishing end.

8. A westco pump as in claim 1, wherein:

the side walls are formed with respective extension grooves extending from the pump channel further beyond the discharge hole in an impeller rotation direction and defining the finishing ends.

9. A westco pump comprising:

a casing in which both end surfaces of a circular peripheral wall are closed by side walls, and forming an intake hole, a discharge hole and a pump channel connecting the two holes;

an impeller disposed in the casing and formed with multiple blade elements on the outer circumference thereof and with a separating wall dividing the pump channel into pump grooves between the blade elements; and an axial clearance between the impeller and axial seal parts formed on the inner surface of the side walls to seal between the intake hole and the discharge hole being made larger than a radial clearance between the impeller and a radial seal part formed on the inner circumference of the circular peripheral wall to seal between the intake hole, wherein, of starting ends and finishing ends of the pump channel formed on the inner circumference of the circular peripheral wall, the finishing ends are shifted from each other in a circumferential direction at both sides of the separating wall of the impeller.

10. A westco pump as in claim 9, wherein:

the starting ends of the pump channel are also shifted from each other in the circumferential direction.

11. A westco pump as in claim 9, wherein:

the shift amount of the finishing ends of the pump channel is about one half of the pitch of the blade elements.

12. A westco pump comprising:

a casing forming therein a generally closed space defined by a circular peripheral wall and side walls, said casing forming an intake hole, a discharge hole and a pump channel in a form of a groove connecting the two holes; and an impeller disposed in the closed space of the casing and formed with multiple blade elements and with a separating wall dividing the pump channel axially into pump grooves between the blade elements, wherein finishing ends of the pump channel formed on the inner surfaces of the side walls are shifted from each other by a predetermined amount less than a pitch of the blade elements in a circumferential direction at the side walls.

13. A westco pump as in claim 12, wherein:

each of the blade elements has protrusions protruding from the separating wall toward the side walls; and the top ends of the protrusions of each respective blade element are located at the same position relative to each other with respect to an impeller rotation direction.

14. A westco pump as in claim 12, wherein:

the predetermined amount of shift is about one half of the pitch of the blade elements.

15. A westco pump as in claim 12, wherein:

a radial clearance between the impeller and a radial seal part formed on the inner circumference of the circular peripheral wall to seal between the intake hole and the discharge hole is made larger than an axial clearance between the impeller and axial seal parts formed on the inner surfaces of the side walls to seal between the intake hole and the discharge hole.

16. A westco pump comprising:

a casing forming therein a generally closed space defined by a circular peripheral wall and side walls, said casing forming an intake hole, a discharge hole and a pump channel in a form of a groove connecting the two holes; and an impeller disposed in the closed space of the casing and formed with multiple blade elements and with a separating wall dividing the pump channel axially into pump grooves between the blade elements, wherein, of starting ends and finishing ends of the pump channel formed on the inner surfaces of the side walls, the starting ends are shifted from each other in a circumferential direction at the side walls.

17. A westco pump as in claim 16, wherein:

each of the blade elements has protrusions protruding from the separating wall toward the side walls; and the top ends of the protrusions of each respective blade element are located at the same position relative to each other with respect to an impeller rotation direction.

18. A westco pump as in claim 16, wherein:

a radial clearance between the impeller and a radial seal part formed on the inner circumference of the circular peripheral wall to seal between the intake hole and the discharge hole is made larger than an axial clearance between the impeller and axial seal parts formed on the inner surfaces of the side walls to seal between the intake hole and the discharge hole.

19. A westco pump as in claim 16, wherein:

the finishing ends are shifted from each other in the circumferential direction.

20. A westco pump as in claim 19, wherein:

the amount of shift of the starting ends in the circumferential direction and the amount of shift of the finishing ends in the circumferential direction are equal to each other.

21. A westco pump as in claim 16, wherein:

the discharge hole is formed on one side wall of the side walls; and the starting end of the pump channel formed on the inner surface of the one side wall is shifted in an impeller rotation direction relative to the starting end of the pump channel formed on the inner surface of the other side wall.

22. A westco pump as in claim 1, wherein:

each of the blade elements has protrusions protruding from the separating wall toward the side walls; and the top ends of the protrusions of each respective blade element are located at the same position relative to each other with respect to an impeller rotation direction.

23. A westco pump as in claim 1, wherein:

the discharge hole is formed on one side wall of the side walls; and the finishing end of the pump channel formed on the inner surface of the one side wall is shifted in an impeller rotation direction relative to the finishing end of the pump channel formed on the inner surface of the other side wall.

24. A westco pump as in claim 1, wherein:

the starting ends are shifted in the circumferential direction from each other; and each shift amount of the starting ends is about one half of the pitch of the blade elements in an impeller rotation direction.

25. A westco pump as in claim 1, wherein:

the blade elements are formed to extend radially on the outer periphery of the impeller.

26. A westco pump as in claim 1, wherein:

a radial clearance between the impeller and a radial seal part formed on the inner circumference of the circular peripheral wall to seal between the intake hole and the discharge hole is made larger than an axial clearance between the impeller and axial seal parts formed on the inner surfaces of the side walls to seal between the intake hole and the discharge hole.

27. A westco pump comprising:

a casing forming therein a generally closed space defined by a circular peripheral wall and side walls, said casing forming an intake hole, a discharge hole and a pump channel in a form of a groove connecting the two holes; and an impeller disposed in the closed space of the casing and formed with multiple blade elements and with a separating wall dividing the pump channel axially into pump grooves between the blade elements, wherein starting ends of the pump channel formed on the inner surfaces of the side walls are shifted from each other by a predetermined amount less than a pitch of the blade elements in a circumferential direction at the side walls.

* * * * *